106-85 AU 115 EX
1/24/78 XR 4,070,195

United States Patent [19]

Toeniskoetter et al.

[11] 4,070,195

[45] * Jan. 24, 1978

[54] PROCESS FOR FABRICATING FOUNDRY SHAPES

[75] Inventors: Richard H. Toeniskoetter, Worthington; John J. Spiwak, Columbus, both of Ohio

[73] Assignee: Ashland Oil, Inc., Ashland, Ky.

[ * ] Notice: The portion of the term of this patent subsequent to Dec. 2, 1992, has been disclaimed.

[21] Appl. No.: 676,728

[22] Filed: Apr. 14, 1976

Related U.S. Application Data

[60] Division of Ser. No. 581,912, May 29, 1975, Pat. No. 3,968,828, which is a division of Ser. No. 415,852, Nov. 14, 1973, Pat. No. 3,930,872, which is a continuation of Ser. No. 351,903, April 17, 1973, Pat. No. 3,923,525.

[51] Int. Cl.[2] ..... B28B 7/34

[52] U.S. Cl. ..... 106/38.3; 106/38.35; 106/38.9; 106/85; 106/286; 164/25; 164/41

[58] Field of Search ..... 106/38.3, 38.35, 38.9, 106/85, 286; 164/41, 43, 25

[56] References Cited

U.S. PATENT DOCUMENTS

| | | | |
|---|---|---|---|
| 2,522,548 | 9/1950 | Streicher | 106/38.9 |
| 3,218,683 | 11/1965 | Nishiyama et al. | 106/38.9 |
| 3,923,525 | 12/1975 | Toeniskoetter | 106/38.3 |
| 3,930,872 | 1/1976 | Toeniskoetter | 106/38.3 |

*Primary Examiner*—Lorenzo B. Hayes

[57] ABSTRACT

Foundry cores are fabricated by mixing aggregate (sand) with a composition comprising boronated aluminum phospate, an oxygen-containing alkaline earth metal compound capable of reacting with the aluminum phosphate, and water. The resulting foundry mix is shaped and allowed to cure at room temperature.

4 Claims, No Drawings

Borron shelf stability Col. 7

Two packages - Col. 8

PROCESS FOR FABRICATING FOUNDRY SHAPES

CROSS REFERENCE TO RELATED CASES

This application is a divisional application of our copending application Ser. No. 581,912, filed May 29, 1975, now U.S. Pat. No. 3,968,828 which is a divisional application of our application Ser. No. 415,852, filed Nov. 14, 1973 (pending at the date of filing of Ser. No. 581,912, but now U.S. Pat. No. 3,930,872), which was a continuing application of our application Ser. No. 351,903, filed Apr. 17, 1973 (pending at the date of filing Ser. No. 415,852, but now U.S. Pat. No. 3,923,525).

BACKGROUND OF THE INVENTION

The present invention relates to binder compositions and methods for curing such binder compositions. The binder compositions of the present invention are especially useful as molding compositions such as refractories, abrasive articles, and molding shapes such as cores and molds. The binder compositions are capable of hardening at room temperature.

Various binder systems now employed including binders for molding compositions employ inorganic substances as the major components. However, prior art binders from inorganic substances have suffered from one or more deficiencies. Typical of the deficiencies exhibited by prior art inorganic binders including the silicates suggested for molding shapes such as cores and molds have been poor collapsibility of the shape and poor removal or "shake out" of the molding shape from the metal casting.

Also, many of the suggested inorganic binders exhibit inadequate bonding strength properties and/or undesirable cure characteristics.

Moreover, various prior art inorganic binders such as the silicates provide molding shapes and particularly ambient temperature cured shapes which possess poor scratch resistance at strip; and accordingly, such shapes require at least a few additional hours after strip time has been achieved to develop adequate scratch resistance. In view of the poor scratch resistance at strip, such shapes cannot be readily handled at strip because of the danger of damage to the shape. Moreover, the sag resistance at strip of the shapes prepared from various prior art binders is not good.

It is therefore an object of the present invention to provide inorganic binder systems which possess acceptable strength characteristics. It is another object of the present invention to provide inorganic binder systems wherein the cure characteristics can be manipulated within certain limits.

It is a further object of the present invention to provide inorganic binder systems for molding shapes which possess relatively good collapsibility and shake out properties as compared to various other suggested inorganic binders.

It is another object of the present invention to provide molding shapes employing inorganic binders which possess good scratch and sag resistance at strip. Likewise, it is an object of the present invention to provide molding shapes from inorganic binder systems which can be readily and easily handled at strip.

SUMMARY OF THE INVENTION

The present invention is concerned with binder compositions which comprise:

A. boronated aluminum phosphate containing boron in an amount from about 3 mole % to about 40 mole % based upon the moles of aluminum and containing a mole ratio of phosphorus to total moles of aluminum and boron of about 2:1 to about 4:1;

B. alkaline earth metal material containing alkaline earth metal and an oxide; and C. water.

The amount of boronated aluminum phosphate is from about 50 to about 95% by weight based upon the total weight of boronated aluminum phosphate and alkaline earth material and the amount of alkaline earth material is from about 50 to about 5% by weight based upon the total weight of boronated aluminum phosphate and alkaline earth material. The amount of water is from about 15 to about 50% by weight based upon the total weight of the boronated aluminum phosphate, and the water.

The present invention is also concerned with compositions for the fabrication of molded articles such as refractories, abrasive articles such as grinding wheels, and shapes used for molding which comprise:

A. a major amount of aggregate; and

B. an effective bonding amount up to about 40% by weight of the aggregate of the binder composition defined above.

The present invention is also concerned with a process for casting of relatively low melting point non-ferrous type metal which comprises fabricating a shape from a composition which contains a major amount of aggrate and an effective bonding amount up to about 40% by weight of the aggregate of the binder composition defined above; pouring the relatively low melting point non-ferrous type metal while in the liquid state into the shape; allowing the non-ferrous type metal to cool and solidify; then contacting the shape with water in an amount and for a time sufficient to cause degradation of the bonding characteristics of the binder system; and then separating of the molded article.

DESCRIPTION OF PREFERRED EMBODIMENTS

The boronated aluminum phosphate constituent of the binder composition of the present invention is an aluminum phosphate which contains boron in an amount from about 3 to about 40 mole % of boron based upon the moles of aluminum. The preferred quantity of boron is between about 5 and about 30 mole % while the most preferred quantity is between about 10 and about 25 mole % based upon the moles of aluminum.

Also, the aluminum phosphate contains a mole ratio of phosphorous to total moles of aluminum and boron of about 2:1 to about 4:1 and preferably from about 2.5:1 to about 3.5:1 and more preferably from about 2.8:1 to about 3.2:1.

The boronated aluminum phosphate is generally prepared by the reaction of an aluminum oxide containing reactant, a source of phosphorus, and a source of boron. It is preferred to employ a method of production wherein the aluminum oxide containing reactant is completely dissolved. Also the boronated aluminum phosphate is preferably prepared from either $P_2O_5$ or concentrated phosphoric acid of from about 70 to about 86% by weight $H_3PO_4$ concentration. The preferred concentrated phosphoric acid solution contains about 86% by weight of $H_3PO_4$. Of course, other sources of phosphorus such as polyphosphoric acids, can be employed, if desired.

Usually the boronated aluminum phosphates are prepared from boric acid and/or boric oxide and/or metallic borates such as alkali metal borates which include sodium borate ($Na_2B_4O_7 \cdot 10H_2O$). It is preferred to use boric acid rather than boric oxide since the acid is in a more usable form than the oxide because of its greater solubility in the reaction system as compared to the oxide. The boronated aluminum phosphates are preferably, but not necessarily, prepared by reacting together the phosphoric acid or $P_2O_5$; and alumina such as alumina trihydrate ($Al_2O_3 \cdot 3H_2O$); and boric acid or boric oxide.

Since the reaction is exothermic, it can generally proceed by merely admixing the reactants and permitting the exotherm to raise the temperature of the reaction mass until the exotherm peaks usually at about 200° to 230° F. After the exotherm peaks, it may be advantageous to apply external heat for about ½ to 2 hours to maintain a maximum reaction temperature between about 220 and about 250° F to ensure completion of the reaction. Also, in some instances, it may be desirable to initiate the reaction by applying external heat just until the exotherm begins.

The reaction is generally carried out at atmospheric pressure. However, higher or lower pressures can be employed, if desired. In addition, the reaction is usually completed within about 1 to about 4 hours and more usually from about 2 to about 3 hours.

The amount of boronated aluminum phosphate employed in the binder system is from about 50 to about 95% by weight and preferably from about 65 to about 90% by weight based upon the total weight of boronated aluminum phosphate and alkaline earth material, and the amount of alkaline earth material is from about 5 to about 50%, and preferably from about 10 to about 35% by weight based upon the total weight of aluminum phosphate and alkaline earth material.

The alkaline earth metal material employed in the present invention is any material containing an alkaline earth metal and containing an oxide which is capable of reacting with the boronated aluminum phosphate. When the alkaline earth metal material is a free alkaline earth metal oxide or a free alkaline earth metal hydroxide, it preferably has a surface area no greater than about 3.5 $m^2$/gram as measured by the BET procedure. More preferably it has a surface area no greater than about 3 $m^2$/gram. Those free oxides and free hydroxides having surface areas no greater than about 8.5 $m^2$/gram are preferred when the binders are employed in molding compositions such as for preparing refractories, abrasive articles and particularly for making shapes such as cores and molds.

It has been observed that compositions of the present invention which employ the preferred oxides and hydroxides have sufficient work times to be adequately mixed in the more conventional types of commercially available batch type mixers before introduction into the mold or pattern for shaping. Although free oxides and free hydroxides having surface areas greater than about 8.5 $m^2$/gram generally are too reactive for use with the more conventional types of commercially available batch type mixers, they are suitable when much faster mixing operations are employed such as those continuous mixing operations which may require only about 20 seconds for adequate mixing or when the binders are to be employed for purposes wherein substantially instantaneous cure is desirable and/or can be tolerated.

Those materials which contain an oxide or hydroxide and an alkaline earth metal, in chemical or physical combination with other constituents are less reactive than the free oxides and hydroxides. Accordingly, such materials can have surface areas greater than about 8.5 $m^2$/gram and be suitable for use even when employing mixing operations which require about 2 to 4 minutes or more.

These other constituents may be present such as being chemically combined with the oxide and alkaline earth metal and/or being physically combined such as by sorption or in the form of an exterior coating. However, the mere mixing of a material with a free oxide or hydroxide without achieving the above type of uniting of the material would not materially reduce the reactivity. Therefore, such mere mixing is not included within the meaning of chemical or physical combinations as used herein.

However, it is preferred that all of the alkaline earth metal materials employed in the present invention have a surface area of no greater than about 8.5 $m^2$/gram and more preferably have a surface area of no greater than about 3 $m^2$/gram. Usually the surface areas are at least about 0.01 $m^2$/gram. All references to surface area unless the contrary is stated, refer to measurements by the BET procedure as set forth in tentative ASTM-D-3037-71T method C-Nitrogen Absorption Surface Area by Continuous Flow Chromatography, Part 28, page 1106, 1972 Edition, employing 0.1 to 0.5 grams of the alkaline earth material.

Included among the suitable materials are calcium oxides, magnesium oxides, calcium silicates, calcium aluminates, calcium aluminum silicates, magnesium silicates, and magnesium aluminates. Also included among the suitable materials of the present invention are the zirconates, borates, and titanates of the alkaline earth metals.

It is preferred to employ either a free alkaline earth metal oxide or a mixture of a free alkaline earth metal oxide and a material which contains the alkaline earth metal and oxide in combination with another constituent such as calcium aluminates. In addition, the preferred alkaline earth metal oxides are the magnesium oxides.

Those materials which include components in combination with the oxide or hydroxide, and the alkaline earth metal, in some instances can be considered as being a latent source of the alkaline earth metal oxide for introducing the alkaline earth metal oxide into the binder system.

Some suitable magnseium oxide materials are available under the trade designations of Magmaster 1-A from Michigan Chemical; Calcined Magnesium oxide, -325 mesh, Cat. No. M-1016 from Cerac/Pure, Inc.; H-W Periklase Grain 94C Grade (Super Ball Mill Fines); H-W Periklase Grain 94C Grade (Regular Ball Mill Fines); and H-W Periklase Grain 98, Super Ball Mill Fines from Harbison-Walker Refractories. Magmaster 1-A has a surface area of about 2.3 $m^2$/gram and Cat. No. M-1016 has a surface area of about 1.4 $m^2$/gram.

A particularly preferred calcium silicate is wollastonite which is a particularly pure mineral in which the ratio of calcium oxide to silica is substantially equal molar.

Generally commercially available calcium aluminate compositions contain from about 15 to about 40% by weight of calcium oxide and from about 35 to about 80% by weight of alumina, with the sum of the calcium oxide and alumina being at least 70% by weight. Of course, it may be desirable to obtain calcium aluminate compositions which contain greater percentages of the calcium oxide. In fact, calcium aluminate containing up to about 45.5% by weight of calcium oxide have been obtained. Some suitable calcium aluminate materials can be obtained commercially under the trade designations Secar 250 and Fondu from Lone Star Lafarge Company, Lumnite and Refcon from Universal Atlas Cement and Alcoa Calcium Aluminate Cement CA-25 from Aluminum Company of America. Fondu has a minimum surface area as measured by ASTM C115 of about 0.15 $m^2$/gram and 0.265 $m^2$/gram as measured by ASTM C205. Lumnite has a Wagner specific surface of 0.17 $m^2$/gram and Refcon has a Wagner specific surface of 0.19 $m^2$/gram.

Mixtures of a free alkaline earth metal oxide and a material containing components in combination with the free oxide or hydroxide and alkaline earth metal preferably contain from about 1 part by weight to about 10 parts and preferably from about 2 to about 8 parts by weight of the free alkaline earth metal oxide per part by weight of the material containing substituents in combination with the free metal oxide or hydroxide and alkaline earth metal. Preferably such mixtures are of magnesium oxides and calcium aluminates. The free alkaline earth metal oxides such as magnesium oxides in such mixtures are primarily responsible for achieving fast cure rates while the other component such as the calcium aluminates are mainly responsible for improving the strength characteristics of the final shaped article. Since the free metal oxide is a much more reactive material than those materials which are latent sources of the free metal oxide, those other materials will only have a minimal effect upon the cure rate when in admixture with the alkaline earth metal oxide.

Sometimes it may be desirable to employ the alkaline earth metal material in the form of a slurry or suspension in a diluent primarily to facilitate material handling. Examples of some suitable liquid diluents include alcohols such as ethylene glycol, furfuryl alcohol, esters such as cellosolve acetate, and hydrocarbons such as kerosene, mineral spirits (odorless), mineral spirits regular, and 140 Solvent available from Ashland Oil, Inc., and Shellflex 131 from Shell Oil, and aromatic hydrocarbons commercially available under the trade designations Hi-Sol 4-2 and Hi-Sol 10 from Ashland Oil, Inc. Of course, mixtures of different diluents can be employed, if desired. In addition, it may be desirable to add a suspending agent to slurries of the alkaline earth material such as Bentone, Cabosil, and Carbopol in amounts up to about 10% and generally up to less than 5% to assist in stabilizing the slurry or suspension in the diluent.

Generally the alkaline earth metal material and diluent are mixed in a weight ratio of about 1:3 to about 3:1 and preferably from about 1:2 to about 2:1. It has been observed that the non-polar hydrocarbons provide the best strength characteristics as compared to the other diluents which have been tested, when a diluent is employed. In addition, the alcohols such as ethylene glycol and furfuryl alcohol are advantageous as liquid diluents since they increase the work time of the foundry mix without a corresponding percentage increase in the strip time. However, the strength properties of the final foundry shape are somewhat reduced when employing alcohols such as ethylene glycol and furfuryl alcohol.

The other necessary component of the binder system employed in the present invention is water. All or a portion of the water can be supplied to the system as the carrier for the boronated aluminum phosphate material. Also, the water can be introduced as a separate ingredient. Of course, the desired quantity of water can be incorporated in part as the water in the boronated aluminum phosphate and in part from another source. The amount of water employed is from about 15 to about 50% by weight and preferably from about 20 to about 40% by weight based upon the total weight of the boronated aluminum phosphate and water.

The aluminum phosphate and water, if admixed, generally have a viscosity between about 100 and 2000 centipoises and preferably between about 200 and 1000 centipoises.

The binder compositions of the present invention make possible the obtaining of molded articles including abrasive articles such as grinding wheels, shapes for molding and refractories such as ceramics, of improved physical properties such as tensile strength as compared to molded articles which are obtained from binder compositions differing only in that the aluminum phosphate does not contain boron. The increased tensile strength is evident at the lower quantity of boron such as at 3 mole %. In addition, the presence of the boron improves the stability of the cured molded article. The percent loss in tensile strength when employing the boron-containing aluminum phosphate materials of the present invention after storage for 48 hours as compared to storage for 24 hours is generally lower as compared to using aluminum phosphates which do not contain boron. This stability effect is particularly noticeable when employing the larger quantities of boron such as from about 10 to about 30% based on the moles of aluminum.

Moreover, the incorporation of boron in the aluminum phosphate is extremely advantageous since it alters the reactivity of the aluminum phosphate with the alkaline earth material in the presence of large amounts of aggregate. As the level of boron in the aluminum phosphate increases, the rate of reaction with the alkaline earth material in the presence of the aggregate decreases. This is particularly noticeable at boron concentrations of at least about 10 mole % based upon the moles of aluminum. Therefore, the presence of boron in the aluminum phosphate makes it possible to readily manipulate the cure characteristics of the binder system so as to tailor the binder within certain limits, to meet the requirements of a particular application of the binder composition.

The alteration in the cure characteristics and particularly with the free alkaline earth oxide; however, has not been observed in the absence of the large amounts of aggregate such as the sand. This may be due to the exothermic nature of the reaction between the boronated aluminum phosphate and free alkaline earth material oxide whereby the presence of the aggregate acts as a heat sink reducing the reactivity to a level where the effect of the boron becomes noticeable. On the other hand, the reaction is so fast in the absence of the aggregate that any effect which the boron may have on cure is not detectable and even if detectable it is of no practical value.

In addition, the presence of the boron provides aluminum phosphate water solutions which exhibit greatly increased shelf stability as compared to aluminum phosphate materials which do not contain boron. The enhanced shelf stability becomes quite significant when employing quantities of boron of at least about 5 mole % based upon the moles of aluminum.

Also, other materials which do not adversely affect the interrelationship between the boronated aluminum phosphate, alkaline earth metal component, and water can be employed, when desired.

When the binder composition of the present invention is used in molding compositions such as for preparing abrasive articles including grinding wheels, refractories including ceramics, and structures for molding such as ordinary sand type foundry shapes and precision casting shapes, aggregate is employed along with the binder of the present invention.

When preparing an ordinary sand type foundry shape, the aggregate employed has a particle size large enough to provide sufficient porosity in the foundry shape to permit escape of volatiles from the shape during the casting operation. The term "ordinary sand type foundry shapes" as used herein refers to foundry shapes which have sufficient porosity to permit escape of volatiles from it during the casting operation. Generally, at least about 80% and preferably about 90% by weight of aggregate employed for foundry shapes has an average particle size no smaller than about 150 mesh (Tyler Screen Mesh). The aggregate for foundry shapes preferably has an average particle size between about 50 and about 150 mesh (Tyler Screen Mesh). The preferred aggregate employed for ordinary foundry shapes is silica wherein at least about 70 weight % and preferably at least about 85 weight % of the sand is silica. Other suitable aggregate materials include zircon, olivine, alumino-silicate sand, chromite sand, and the like.

When preparing a shape for precision casting, the predominate portion and generally at least about 80% of the aggregate has an average particle size no larger than 150 mesh (Tyler Screen Mesh) and preferably between about 325 mesh and 200 mesh (Tyler Screen Mesh). Preferably at least about 90% by weight of the aggregate for precision casting applications has a particle size no larger than 150 mesh and preferably between 325 mesh and 200 mesh. The preferred aggregates employed for precision casting applications are fused quartz, zircon sands, magnesium silicate sands such as olivine, and aluminosilicate sands.

Shapes for precision casting differ from ordinary sand type foundry shapes in that the aggregate in shapes for precision casting can be more densely packed than the aggregate in shapes for ordinary sand type foundry shapes. Therefore, shapes for precision casting must be heated before being utilized to drive off volatilizable material, present in the molding composition. If the volatiles are not removed from a precision casting shape before use, vapor created during casting will diffuse into the molten metal since the shape has a relatively low porosity. The vapor diffusion would decrease the smoothness of the surface of the precision cast article.

When preparing a refractory such as a ceramic, the predominant portion and at least 80 weight % of the aggregate employed has an average particle size under 200 mesh and preferably no larger than 325 mesh. Preferably at least about 90% by weight of the aggregate for a refractory has an average particle size under 200 mesh and preferably no larger than 325 mesh. The aggregate employed in the preparation of refractories must be capable of withstanding the curing temperatures such as above about 1500° F which are needed to cause sintering for utilization. Examples of some suitable aggregates employed for preparing refractories include the ceramics such as refractory oxides, carbides, nitrides, and silicides such as aluminum oxide, lead oxide, chromic oxide, zirconium oxide, silica, silicon carbide, titanium nitride, boron nitride, molybdenum disilicide, and carbonaceous material such as graphite. Mixtures of the aggregates can also be used, when desired, including mixtures of metals and the ceramics.

Examples of some abrasive grains for preparing abrasive articles include aluminum oxide, silicon carbide, boron carbide, corundum, garnet, emery and mixtures thereof. The grit size is of the usual grades as graded by the United States Bureau of Standards. These abrasive materials and their uses for particular jobs are understood by persons skilled in the art and are not altered in the abrasive articles contemplated by the present invention. In addition, inorganic fillers can be employed along with the abrasive grit in preparing abrasive articles. It is preferred that at least about 85% of the inorganic fillers have average particle size no greater than 200 mesh. It is most preferred that at least about 95% of the inorganic filler has an average particle size no greater than 200 mesh. Some inorganic fillers include cryolite, fluorospar, silica and the like. When an inorganic filler is employed along with the abrasive grit, it is generally present in amounts from about 1 to about 30% by weight based upon the combined weight of the abrasive grit and inorganic filler.

Although the aggregate employed is preferably dry, it can contain small amounts of moisture, such as up to about 0.3% by weight or even higher based on the weight of the aggregate. Such moisture present on the aggregate can be compensated for, by altering the quantity of water added to the composition along with the other components such as the boronated aluminum phosphate, and alkaline earth metal material.

In molding compositions, the aggregate constitutes the major constituent and the binder constitutes a relatively minor amount. In ordinary sand type foundry applications, the amount of binder is generally no greater than about 10% by weight and frequently within the range of about 0.5 to about 7% by weight, based upon the weight of the aggregate. Most often, the binder content ranges from about 1 to about 5% by weight based upon the weight of the aggregate in ordinary sand type foundry shapes.

In molds and cores for precision casting applications, the amount of binder is generally no greater than about 40% by weight and frequently within the range of about 5 to about 20% by weight based upon the weight of the aggregate.

In refractories, the amount of binder is generally no greater than about 40% by weight and frequently within the range of about 5% to about 20% by weight based upon the weight of the aggregate.

In abrasive articles, the amount of binder is generally no greater than about 25% by weight and frequently within the range of about 5% to about 15% by weight based upon the weight of the abrasive material or grit.

At the present time, it is contemplated that the binder compositions of the present invention are to be made available as a two-package system comprising the aluminum phosphate and water components in one package and the alkaline earth metal component in the other package.

class 206

When the binder compositions are to be employed along with an aggregate, the contents of the package containing the alkaline earth metal component are usually admixed with the aggregate, and then the contents of the aluminum phosphate containing package are admixed with the aggregate and alkaline earth metal component composition. After a uniform distribution of the binder system on the particles of aggregate has been obtained, the resulting mix is molded into the desired shape. Methods of distributing the binder on the aggregate particles are well known to those skilled in the art. The mix can, optionally, contain ingredients such as iron oxide, ground flax fibers, wood cereals, clay, pitch, refractory flours, and the like.

The binder systems of the present invention are capable of ambient temperature cure which is used herein to include curing by chemical reaction without the need of external heating means. However, within the general description of ambient temperature cure, there are a number of different ambient temperature curing mechanisms which can be employed. For example, ambient temperature cure encompasses both "air cure" and "no bake". Normally, ambient temperature cure is effected at temperatures of from about 50° F to about 120° F.

Moreover, the molding shapes of the present invention have good scratch resistance and sag resistance immediately at strip. Accordingly, the molding shapes of the present invention can be easily and readily handled and employed immediately after strip.

In addition, the binder systems of the present invention make possible the achievement of molding shapes which possess improved collapsibility and shake out of the shape when used for the casting of the relatively high melting point ferrous-type metals such as iron and steel which are poured at about 2500° F, as compared to other inorganic binder systems such as the silicates. Furthermore, the binder systems of the present invention make possible the preparation of molding shapes which can be employed for the casting of the relatively low melting point non-ferrous type metals such as aluminum, copper, and copper alloys including brass. The temperatures at which such metals are poured in certain instances are not high enough to adequately degrade the bonding characteristics of the binder systems of the present invention to the extent necessary to provide the degree of collapsibility and shake out by simple mechanical forces which are usually desired in commercial type of applications. However, the binder systems of the present invention make it possible to provide molding shapes which can be collapsed and skaken out from castings of the relatively low melting point non-ferrous type metals and particularly aluminum, by water leaching. The shapes can be exposed to water such as by soaking or by a water spray. Moreover, it has been observed that the surface appearance of aluminum cast articles when employing shapes according to the present invention is quite good.

Steel
Ferrous type
Al
Cu
Brass
water leaching

When the compositions of the present invention are used to prepare oridinary sand type foundry shapes, the following steps are employed:

1. forming a foundry mix containing an aggregate (e.g., sand) and the contents of the binder system;
2. introducing the foundry mix into a mold or pattern to thereby obtain a green foundry shape;
3. allowing the green foundry shape to remain in the mold or pattern for a time at least sufficient for the shape to obtain a minimum stripping strength (i.e., become self-supporting); and
4. thereafter removing the shape from the mold or pattern and allowing it to cure at room temperature, thereby obtaining a hard, solid, cured foundry shape.

In order to further understand the present invention the following non-limiting examples concerned with foundry shapes are provided. All parts are by weight unless the contrary is stated. In all the examples, the foundry samples are cured by no-bake procedure at room temperature unless the contrary is stated.

EXAMPLE 1

To a reaction vessel equipped with a stirrer, thermometer, and pressure gauge, are added with agitation about 38,000 parts of an 80% aqueous solution of phosphoric acid, about 307 parts boric acid, and about 7720 parts of hydrated alumina (Alcoa C-33). The reaction mass is heated to a temperature of about 120° F in about ½ hour at which time external heat is removed. The reaction is continued for about another 20 minutes with the temperature rising to a maximum of about 180° F due to the reaction exotherm. Then external heat is applied and reaction temperature rises to a maximum of about 235° F in about 70 minutes. The pressure in the reaction vessel rises to a maximum of about 15 psig. The reaction mass is cooled to about 155° F in about 45 minutes at which time about 5900 parts of water are added with agitation. The reaction mass is then cooled down to 82° F under reduced pressure of about 3 inches of mercury. The vacuum is removed and about 52,000 parts of a boronated aluminum phosphate product having a solids content of 66.6%, a viscosity of 250–300 centipoises, mole ratio of phosphorous to total moles of aluminum and boron of 3:1, and about 5 mole % boron based upon the moles of aluminum are obtained.

100 parts of Wedron 5010 sand and about 0.85 parts of a slurry of 0.4 parts kerosene and 0.45 parts magnesium oxide having a surface area of about 2.3 $m^2/gm$ (Magmaster 1-A) are admixed for about 2 minutes. According to the manufacturer, Wedron 5010 sand is 99.88% silica, 0.02% iron oxide, 0.10% aluminum oxide, 0.15% titanium dioxide, .01% calcium oxide, and 0.005% magnesium oxide, and has the following size distribution: 0.4% retained on U.S. No. 40, 11.2% retained on U.S. No. 50, 35.2% retained on U.S. No. 70, 37.4% retained on U.S. No. 100, 10.8% retained on U.S. No. 140, 4.0% retained on U.S. No. 200, 0.8% retained on U.S. No. 200, 0.8% retained on U.S. No. 270, 0.2% retained on U.S. No. 325, and 66.92 Grain fineness (AFS). To this mixture are added 3.2 parts of the boronated aluminum phosphate prepared above. The mixture is then agitated for 2 minutes.

The resulting foundry mix is formed by hand ramming into standard AFS tensile strength samples using the standard procedure. The tensile strength of the test bars is 75 psi after 2 hours, 105 psi after 4 hours, 140 psi after 6 hours, and 170 psi after 24 hours at room temperature. In addition, the composition has a work time of 10 minutes and a strip time of between 35 and 40 minutes. The scratch resistance at strip is very good and after 2 hours is excellent.

EXAMPLE 2

Example 1 is repeated except that the total binder mix is about 3.5% by weight based upon the sand with the various binder components in the same ratio as above. The resulting foundry mix is formed into standard AFS tensile strength samples using the standard procedure.

The tensile strength of the test bars is 75 psi after 2 hours, 120 psi after 4 hours, 145 psi after 6 hours, and 165 psi after 24 hours at room temperature.

The samples have excellent scratch resistance after 2 hours. In addition, the work time of the composition is 10 minutes and the strip time of the composition is between 40 and 45 minutes.

EXAMPLE 3

5000 parts of Wedron-5010 sand and 35 parts of a mixture of magnesium oxide (Magmaster 1-A) and a calcium aluminate containing 58% $Al_2O_3$ and 33% CaO, commercially available as Refcon from Universal Atlas, in a ratio of 2.5 parts of magnesium oxide to 1 part of the calcium aluminate are mixed for about 2 minutes. To this mixture are added 165 parts of a 66% aqueous aluminum phosphate solution prepared according to the procedure of Example 1. The mixture is then agitated for 2 minutes.

The resulting foundry mix is formed into standard AFS tensile strength samples using the standard procedure. The tensile strength of the test bars after 24 hours at room temperature is 170 psi. In addition, the composition has a work time of 10 minutes and a strip time of 30 minutes. The scratch resistance at strip is very good and after 2 hours is excellent.

EXAMPLE 4

Example 3 is repeated except that 30 parts of the magnesium oxide-calcium aluminate mixture is employed. The resulting foundry mix is formed into standard AFS tensile strength samples using the standard procedure. Tensile strength of the test bars is 80 psi after 2 hours, 160 psi after 4 hours, 178 psi after 6 hours, and 196 psi after 24 hours at room temperature. In addition, the composition has a work time of 15 minutes and a strip time of 45 minutes.

The following Examples 5–9 illustrate the effect of the surface area of the alkaline earth metal oxide containing material when it is a free oxide such as MgO.

EXAMPLE 5

5000 parts of Wedron 5010 silica sand and 25 parts of magnesium oxide having a surface area of about 2.3 $m^2$/gram commercially available from Michigan Chemical as Magmaster 1-A are mixed for about 2 minutes. To this mixture are added 165 parts of a 66% aluminum phosphate solution prepared according to the procedure of Example 1. The mixture is then agitated for 2 minutes. The resulting foundry mix has a work time between 10 and 20 minutes.

EXAMPLE 6

Example 5 is repeated except that the magnesium oxide employed has a surface area of about 1.4 $m^2$/gram and is commercially available under the trade designation Calcined Magnesium Oxide, -325 mesh Cat. No. M-1016 and the aluminum phosphate contains 10 mole % based upon the moles of aluminum. The foundry mix has a work time of about 15 minutes.

EXAMPLE 7

Example 6 is repeated except that the magnesium oxide employed has a surface area of about 35.2 $m^2$/gram and is commercially available as Magox 98 LR. The composition has a work time of less than 2 minutes, and therefore; requires the use of a relatively fast mixing operation.

EXAMPLE 8

Example 6 is repeated except that the magnesium oxide has a surface area of about 61.3 $m^2$/gram and is commercially available as Michigan 1782. The composition has a work time of less than 2 minutes, and therefore; requires the use of a relatively fast mixing operation.

EXAMPLE 9

Example 5 is repeated except that the magnesium oxide has a surface area of about 8.2 $m^2$/gram and is obtained by calcining Michigan 1782 at 1000° C for 24 hours and the aluminum phosphate contains 30 mole % boron based upon the moles of aluminum. The composition has a work time of between 2 and 4 minutes and therefore can be adequately mixed into a foundry mix employing the more conventional mixing operations. However, the work time may be somewhat shorter than that necessary for safely mixing and forming the desired shape before curing for some operations.

EXAMPLE 10

The following Table 1 illustrates the effect of employing different levels of boron on the work time and strip time. The compositions are prepared by mixing for about 2 minutes.

5000 parts of Wedron 5010 silica sand and the amount specified in Table 1 of a mixture of magnesium oxide (Magmaster 1-A) and a calcium aluminate containing 58% $Al_2O_3$ and 33% CaO (commercially available as Refcon from Universal Atlas) in a ratio of 2.5 parts of magnesium oxide to 1 part of calcium aluminate. To the mixture are added 165 parts of the aluminum phosphate solutions specified in Table 1. The aluminum phosphate solutions are obtained from a mole ratio of phosphorus to total moles of aluminum and boron of 3:1.

Table 1

Effect of Boron Level on Work Time and Strip Time WT (min.)/ST (min.)

| | 68% Aqueous Aluminum Phosphate Solution | | 66% Aqueous Aluminum Phosphate Solution | |
|---|---|---|---|---|
| Boron Level | 25 parts MgO—Ca aluminate mix | 30 parts MgO—Ca aluminate mix | 25 parts Mgo—Ca aluminate mix | 30 parts MgO—Ca aluminate mix |
| 30% | 30/>100 | 20/80 | 25/150 | 15/75 |
| 20% | 25/100 | 15/60 | 30/>90 | 15/70 |
| 10% | 20/90 | 15/60 | 20/80 | 10/55 |
| 5% | 15/75 | 10/60 | 15/75 | 10/50 |
| 3% | 15/75 | 10/55 | 10/65 | 10/50 |
| 1% | 10/70 | 10/50 | 10/70 | 10/50 |
| 0% | 10/65 | 10/50 | 10/65 | 10/50 |

In addition, storage tests on the various aluminum phosphate solutions employed in this example reveal that some precipitation from 0, 1 and 3 mole % boron occurs after only 14 days storage. The other aluminum phosphate solutions remain clear.

The various foundry mix compositions employed in this example are formed in standard AFS tensile strength samples using the standard procedure. The tensile strength results after 24 hours and 48 hours at room temperature are recorded on Tables II and III, below. It is evident from Tables II and III that the aluminum phosphate obtained from boron generally provides improved tensile strength characteristics. It is apparent that the general trend is improvement in tensile strength with increasing quantities of boron, although a few of the tensile strengths do not fit the general behavior due to some experimental error.

Table II

| Effect of Boron Level on Tensile Strength at 24 Hours after Strip | | | | |
|---|---|---|---|---|
| | 68% Aqueous Aluminum Phosphate Solution | | 66% Aqueous Aluminum Phosphate Solution | |
| Boron Level | 25 parts MgO—Ca aluminate mix | 30 parts MgO—Ca aluminate mix | 25 parts MgO—Ca aluminate mix | 30 parts MgO—Ca aluminate mix |
| 30% | 190 | 164 | 174 | 159 |
| 20% | 181 | 172 | 182 | 162 |
| 10% | 170 | 146 | 167 | 132 |
| 5% | 162 | 133 | 174 | 135 |
| 3% | | 147 | 165 | 140 |
| 1% | 162 | 140 | 150 | 124 |
| 0% | 157 | 150 | 157 | 103 |

Table III

| Effect of Boron Level on Tensile Strength at 48 Hours after Strip | | | | |
|---|---|---|---|---|
| | 68% Aqueous Aluminum Phosphate Solution | | 66% Aqueous Aluminum Phosphate Solution | |
| Boron Level | 25 parts MgO—Ca aluminate mix | 30 parts MgO—Ca aluminate mix | 25 parts MgO—Ca aluminate mix | 30 parts MgO—Ca aluminate mix |
| 30% | 182 | 156 | 171 | 160 |
| 20% | 171 | 164 | 152 | 138 |
| 10% | 156 | 137 | 165 | 126 |
| 5% | 158 | 150 | 170 | 116 |
| 3% | 164 | 126 | 147 | 126 |
| 1% | 152 | 130 | 130 | 113 |
| 0% | 140 | 120 | 142 | 90 |

EXAMPLE 11

The following Table IV further illustrates the improved shelf stability obtained by employing boron.

Table IV

| Stability of Aluminum Phosphate Solution | | | |
|---|---|---|---|
| Mole Ratio of Aluminum + Boron to Phosphorus | % % Solids | Boron Level (Mole % of Aluminum) | Appearance |
| 1:3.8 | 77% | 20% | Clear after 11 months |
| 1:3.8 | 77% | 10% | Clear after 11 months |
| 1:3.8 | 77% | 5% | Clear after 11 months |
| 1:3.8 | 77% | 0% | Clear after 11 months |
| 1:3.6 | 76% | 40% | Clear after 11 months |
| 1:3.6 | 76% | 20% | Clear after 11 months |
| 1:3.6 | 76% | 10% | Clear after 11 months |
| 1:3.6 | 76% | 5% | Clear after 11 months |
| 1:3.6 | 75% | 0% | Precipitation after 10 months |
| 1:3.4 | 75% | 20% | Clear after 11 months |
| 1:3.4 | 75% | 20% | Clear after 10 months |
| 1:3.4 | 75% | 10% | Clear after 11 months |
| 1:3.4 | 75% | 10% | Clear after 10 months |
| 1:3.4 | 75% | 5% | Clear for 1½ months then precipitated |
| 1:3.4 | 75% | 5% | Clear for 2 months then precipitated |
| 1:3.4 | 75% | 0% | Clear for 1 month then precipitated |
| 1:3.2 | 75% | 5% | Clear for 1 month then precipitated |

Table IV-continued

| Stability of Aluminum Phosphate Solution | | | |
|---|---|---|---|
| Mole Ratio of Aluminum + Boron to Phosphorus | % % Solids | Boron Level (Mole % of Aluminum) | Appearance |
| 1:3.1 | 75% | 10% | Precipitated after 10 months |
| 1:3.0 | 75% | 30% | Clear after about 12 months |
| 1:3.0 | 68% | 30 | Clear after about 12 months |
| 1:3.0 | 67% | 30% | Clear after about 12 months |
| 1:3.0 | 65% | 30% | Clear after about 12 months |
| 1:3.0 | 75% | 20% | Clear after about 12 months |
| 1:3.0 | 68% | 20% | Clear after about 12 months |
| 1:3.0 | 67% | 20% | Clear after about 12 months |
| 1:3.0 | 65% | 20% | Clear after about 12 months |
| 1:3.0 | 75% | 10% | Clear for at least about 2½ months, precipitated before 6 months |
| 1:3.0 | 68% | 10% | Clear for at least about 10 months and then precipitated |
| 1:3.0 | 67% | 10% | Clear for at least about 10 months and then precipitated |
| 1:3.0 | 65% | 10% | Clear for at least about 10 months and then precipitated |
| 1:3.0 | 75% | 5% | Clear for at least about 2½ months, before 6 months |
| 1:3.0 | 68% | 5% | Clear for at least about 2½ months, precipitated before 6 months |
| 1:3.0 | 67% | 5% | Clear for at least about 2½ months, precipitated before 6 months |
| 1:3.0 | 65% | 5% | Clear for at least about 2½ months, precipitated before 6 months |
| 1:3.0 | 75% | 3% | Clear for at least about 2½ months, precipitated before 6 months |
| 1:3.0 | 68% | 3% | Precipitated |
| 1:3.0 | 67% | 3% | Clear for at least anbout 2½ months, precipitated before 6 months |
| 1:3.0 | 65% | 3% | Clear for at least about 2½ months, precipitated before 6 months |
| 1:3.0 | 75% | 1% | Clear for at least about 2½ months, precipitated before 6 months |
| 1:3.0 | 68% | 1% | Precipitated after about 2½ months |
| 1:3.0 | 67% | 1% | Precipitated after about 2½ months |
| 1:3.0 | 65% | 1% | Precipitated after about 2½ months |
| 1:3.0 | 75% | 0% | Clear for at least about 2½ months, precipitated before 6 months |
| 1:3.0 | 68% | 0% | Precipitated after about 2½ months |
| 1:3.0 | 67% | 0% | precipitated after about 2½ months |
| 1:3.0 | 65% | 0% | Slight precipitation after about 2½ months |

The following examples 12 and 13 illustrate the improved scratch resistance and sag resistance at strip of foundry shapes prepared according to the present invention as compared to the scratch resistance and sag resistance at strip of foundry shapes prepared from other prior art inorganic binder systems.

EXAMPLE 12

20,000 parts of Port Cresent Lake sand and 200 parts of a mixture of 60 parts kerosene, 85.6 parts of magnesium oxide (Magmaster 1-A) and 34.4 parts of calcium aluminate containing 58% $Al_2O_3$ and 33% CaO, commercially available as Refcon from Universal Atlas, are mixed for about 2 minutes. To this mixture are added 660 parts of a 66% aqueous aluminum phosphate solution prepared according to the procedure of Example 1, having a viscosity of 250–300 centipoises, a mole ratio of phosphorus to total moles of aluminum and boron of 3:1 and about 10 mole % of boron based upon the moles of aluminum. The mixture is then agitated for 2 minutes.

The resulting foundry mix is formed into 4 inch by 4 inch by 18 inch sand cores weighing about 19 pounds each. The composition has a work time of 10 minutes and a strip time of 45 minutes. The scratch resistance of the cores at strip is 85–90 and after 1 hour is 90–95.

Three core samples are laid horizontally on the edge of a lab table at strip so that 6 inches extend over the table without support. The cores are allowed to remain in this position for one hour. After one hour, a slight sag of the cores is noted which measures no more than one-sixteenth of an inch from the horizontal.

Likewise, sag tests are conducted for the cores employing three core samples each, whereby the cores are supported at the extremities leaving the central portion unsupported, and whereby the cores are supported at the center with the ends unsupported, and by allowing the cores to remain in a vertical position supported by its 4 inch × 4 inch base.

In all instances, no noticeable sag is observed for these cores and no slump is noted after standing for 24 hours.

In addition, three cores are prepared and immediately wrapped in plastic bags at strip and then supported horizontally at the extremities and three other cores are prepared and wrapped in plastic bags at strip and supported horizontally in the center. Some sag on these cores is observed within the first hour.

Two 4 inch × 4 inch × 18 inch cores are prepared from the above compositions whereby hooks are inserted 3 inches in from each end of the core at a depth of about 2 inches. One of the cores is stripped in 30 minutes and suspended from each end in a horizontal position. This core slumps and breaks within 3 minutes. The other core is stripped in 45 minutes and immediately suspended in a horizontal position from both ends. This core remains in this position for 24 hours without any noticeable sag.

A five gallon pail is filled with a sand mix containing the above sand-binder composition. A hook is inserted through a depth of 4 inches in the center of the core and the system suspended at strip time of 45 minutes. Total weight suspended is 73 pounds and after 24 hours, no evidence of the hook breaking from the core is detected. At this time an additional 170 pounds are placed on the suspended core for 5 minutes with no adverse effects.

Standard tensile strength specimens are also prepared from the above compositions whereby specimens are taken immediately after mixing and at 5, 10, and 17 minute intervals after mixing. Overnight strengths of the product are 206 psi for specimens prepared immediately after mixing, 160 psi for specimens prepared after 10 minutes mixing and 60 psi for specimens prepared after 17 minutes mixing. The drop in tensile strength 5 minutes after mixing indicates that the binder reaction is proceeding somewhat faster than desired. In addition, some degradation of the core properties occurs during storage. For instance, the cores have an average scratch hardness of 70 after 4 days as compared to the initial scratch hardness.

EXAMPLE 13

10,000 parts of Port Crescent Lake sand and 42 parts of an organic ester hardener commercially available under the trade designation Chem. Rez 3000 are mixed for about 2 minutes. To this mixture are added 350 parts of a sodium silicate binder having a 2.4:1 ratio of $SiO_2$ to $Na_2O$ commercially available under the trade designation Chem. Rez 318. The mixture is then agitated for 2 minutes.

The composition has a work time of 20 minutes and a strip time of 45 minutes, the scratch resistance of the cores is only 9–10 at strip and about 80–90 after 3 hours of storing. The composition is formed into 4 inch × 4 inch × 18 inch sand cores weighing about 19 pounds. Three of the cores are laid horizontally on the edge of the lab table at strip so that 6 inches extends over the lab table without support. These cores sag from one-half inch to three-fourths inch from the horizontal. Likewise, other sag tests are conducted wherein 3 cores are supported at the extremities leaving the central portion unsupported, and three cores are supported at the center with the ends unsupported, and three cores are allowed to remain in the vertical position supported by their 4 inch × 4 inch base. It is observed that the cores sag at least one-half inch from the horizontal within one hour and in one instance the core completely breaks in half. In addition, the core supported in the vertical position settles somewhat with a slight bulge towards the center. The scratch resistance of the cores after one hour is between 30 and 40. In addition, three cores are prepared and immediately wrapped in plastic bags at strip and supported horizontally at the extremities and at the center. The cores sag from about one-fourth to about three-fourths inches and the cores exhibit a much greater degree of slump as compared to the same test carried out with the composition of Example 12.

A comparison of Examples 12 and 13 clearly demonstrates the improved scratch resistance at strip and sag resistance at strip achieved by the binders of the present invention as compared to other common inorganic binders. Moreover, it is quite apparent that in view of the relative hardness of the cores prepared according to the present invention at strip, it is much easier to handle such cores than to handle cores obtained from the sodium silicate binders.

EXAMPLE 14

5000 parts of Port Crescent sand and 50 parts of a slurry of 20 parts of odorless mineral spirits (flash point 128° F, boiling range 355°–400° F) and 30 parts of a mixture of magnesium oxide (Magmaster 1-A) and a calcium aluminate containing 58% $Al_2O_3$ and 33% CaO, commercially available as Refcon from Universal Atlas, in a ratio of 5 parts of magnesium oxide to 1 part of the calcium aluminate are mixed for about 2 minutes. To this mixture was added 165 parts of a 67% aqueous aluminum phosphate solution containing mole ratio of phosphorus to total moles of aluminum and boron of 3:1 and about 20 mole % boron based upon the moles of aluminum. The mixture is then agitated for 2 minutes.

The resulting foundry mix is formed into standard AFS tensile strength samples using the standard procedure. The tensile strength of the test bars is about 75 psi after 2 hours, about 195 psi after 24 hours, about 187 psi after 48 hours, and about 185 psi after 120 hours. In addition, the composition has a work time of 17 minutes and a strip time of 66 minutes. The scratch resistance at strip is very good.

EXAMPLE 15

Example 14 is repeated except that 20 parts of mineral spirits (regular) (flash point 105° F, boiling range 315°-378° F) are used in place of the 20 parts of odorless mineral spirits.

The resulting foundry mix is formed into standard AFS tensile strength samples using the standard procedure. The tensile strength of the test bars is about 70 psi after 2 hours, about 187 psi after 24 hours, about 198 after 48 hours and about 160 psi after 120 hours at room temperature. In addition, the composition has a work time of 16 minutes and a strip time of 62 minutes. The scratch resistance at strip is very good.

EXAMPLE 16

Example 14 is repeated except that 20 parts of Shellflex 131 (flash point 300° F, boiling range 550°-680° F) are used in place of the 20 parts of odorless mineral spirits.

The resulting foundry mix is formed into standard AFS tensile strength samples using the standard procedure. The tensile strength of the test bars is about 75 after 2 hours, about 203 after 12 hours, about 208 after 48 hours and about 145 psi after 120 hours at room temperature. In addition, the composition has a work time of 18 minutes and a strip time of 64 minutes. The scratch resistance at strip is very good.

EXAMPLE 17

Example 14 is repeated except that 20 parts of 140 solvent commercially available from Ashland Oil, Inc., (flash point 140° F, boiling range 360°-390° F) are used in place of the 20 parts of odorless mineral spirits.

The resulting foundry mix is formed into standard AFS tensile strength samples using the standard procedure. The tensile strength of the test bars is about 87 psi after 2 hours, about 183 psi after 12 hours, about 198 psi after 48 hours and about 163 psi after 120 hours. In addition, the composition has a work time of 18 minutes and a strip time of 61 minutes. The scratch resistance at strip is very good.

EXAMPLE 18

Example 14 is repeated except that 20 parts of kerosene (flash point 120° F, boiling range 340°-530° F) are used in place of the 20 parts of odorless mineral spirits.

The foundry mix is formed into standard AFS tensile strength samples using the standard procedure. The tensile strength of the test bars is about 93 psi after 2 hours, about 168 psi after 4 hours, about 200 psi after 6 hours, about 208 psi after about 12 hours, and about 135 psi after 96 hours. In addition, the composition has a work time of 16 minutes and a strip time of 60 minutes. The scratch resistance at strip is very good.

EXAMPLE 19

To a reaction vessel equipped with a stirrer, thermometer, and reflux condenser are added about 2445 parts of 85% phosphoric acid. Then about 67 parts of sodium borate are added with agitation, and the agitation is continued for about 10 minutes until the borate dissolves in the acid to form a clear solution. To this solution are added about 540 parts of hydrated alumina (Alcoa C-33) under agitation. The reaction proceeds for about 40 minutes with the temperature rising to a maximum of about 220° F due to the reaction exotherm. Then external heat is applied and reaction temperature rises to a maximum of about 245° F. The reaction mass is held at about 245° F for about 2 hours to ensure complete reaction. The reaction mass is then cooled to room temperature and about 3052 parts of a boronated aluminum phosphate having a solids content of about 75%, a viscosity of about 40,000 centipoises, a mole ratio of phosphorus to total moles of aluminum and boron of 3:1 and about 10 mole % boron based upon the moles of aluminum are obtained.

5000 parts of Port Crescent Lake Sand and about 30 parts of a mixture of magnesium oxide (Magmaster 1-A) and a calcium aluminate containing 58% $Al_2O_3$ and 33% CaO (Refcon) in a ratio of 2.5 parts of magnesium oxide to 1 part of calcium aluminate are mixed for about 2 minutes. To this mixture are added 165 parts of a 66% solids solution having a viscosity of 400-500 centipoises of 146.5 parts of the boronated aluminum phosphate prepared above and 18.5 parts of water. The mixture is then agitated for 2 minutes.

The resulting foundry mix is formed by hand ramming into standard AFS tensile strength samples using the standard procedure. The tensile strength of the test bars is 125 psi after 2 hours, 165 psi after 4 hours, 160 psi after 6 hours and 120 psi after 24 hours at room temperature. The core hardness as measured on a No. 64 Core Hardness Tester commercially available from Harry W. Dietert Co., Detroit Michigan, is 75 after 2 hours, 72 after 4 hours, 74 after 6 hours, and 65 after 24 hours.

The work time of the composition is 13 minutes and the strip time is 42 minutes.

EXAMPLE 20

Example 19 is repeated except that a non-boronated aluminum phosphate containing the same amount of sodium (10 mole % based upon the aluminum) as present in the boronated aluminum phosphate of Example 19 is employed. The sodium is incorporated by employing tribasic sodium phosphate in preparing the aluminum phosphate.

The resulting foundry mix is formed by hand ramming into standard AFS tensile strength samples using the standard procedure. The tensile strength of the test bars is 130 psi after 2 hours, 160 psi after 4 hours, and 50 psi after 24 hours at room temperature. The core hardness is 80 after 2 hours, 78 after 4 hours and 52 after 24 hours. The work time of the composition is 9 minutes and the strip time is 28 minutes.

EXAMPLE 21

Example 19 is repeated except that a boronated aluminum phosphate containing 20 mole % boron and 20 mole % sodium based upon the aluminum and prepared according to the procedure of Example 19 is employed.

The resulting foundry mix is formed by hand ramming into standard AFS tensile strength samples using the standard procedure. The tensile strength of the test bars is about 100 psi after 2 hours, about 155 psi after 4 hours, about 110 psi after 6 hours and about 65 psi after 24 hours at room temperature.

The core hardness is 58 after 2 hours, 77 after 4 hours, 50 after 6 hours and 32 after 24 hours. The work time of the composition is 15 minutes and the strip time is 38 minutes.

EXAMPLE 22

Example 21 is repeated except that a non-boronated aluminum phosphate containing the same amount of sodium (20 mole % based upon the aluminum) as present in boronated aluminum phosphate of Example 21 is employed. The sodium is incorporated by employing tribasic sodium phosphate in preparing the aluminum phosphate.

The resulting foundry mix is formed into standard AFS tensile strength samples by hand ramming using the standard procedure. The tensile strength of the test bars is about 100 psi after 2 hours, about 150 psi after 4 hours, and about 40 psi after 24 hours at room temperature. In addition, the composition has a work time of 8 minutes and a strip time of 22 minutes.

The core hardness is 74 after 2 hours, 70 after 4 hours, and 42 after 24 hours.

EXAMPLE 23

Example 19 is repeated except that a non-boronated aluminum phosphate containing 3 moles of phosphorus per mole of aluminum and being free of sodium is employed.

The resulting foundry mix is formed into standard AFS tensile strength samples by hand ramming using the standard AFS tensile strength samples by hand ramming using the standard procedure. The tensile strength of the test bars is about 95 psi after 2 hours, about 150 psi after 4 hours, about 150 psi after 6 hours, and about 95 psi after 24 hours at room temperature. In addition, the composition has a work time of 12 minutes and a strip time of 35 minutes.

The core hardness is 73 after 2 hours, 69 after 4 hours, 70 after 6 hours and 66 after 24 hours.

A comparison of Example 19 with Example 20 and of Example 21 with Example 22 illustrates improved core stability achieved by the present invention as evidenced by the higher tensile strengths at 24 hours of the boron-containing aluminum phosphates as compared to the non-boronated aluminum phosphates. The improvement in core stability achieved by the presence of boron in the aluminum phosphates which contain sodium in some instances is not as pronounced as the improvement by including boron in aluminum phosphates which do not contain sodium, due to the deleterious effect of the sodium upon such properties as evidenced by a comparison of Examples 20 and 22 with Example 23. Nonetheless, the presence of boron in such materials is still quite advantageous. For example, it may be desired to include sodium in the aluminum phosphate for some other purpose such as improving the ratio of strip time to work time in some instances.

The following example demonstrates the use of cores obtained from the compositions of the present invention to cast relatively low melting point non-ferrous metals.

EXAMPLE 24

10,000 parts of Wedron 5010 sand and about 70 parts of a mixture of magnesium oxide (Magmaster 1-A) and a calcium aluminate containing 58% $Al_2O_3$ and 33% CaO (Refcon) in a ratio of 2.5 parts of magnesium oxide to 1 part of the calcium aluminate are mixed for about 2 minutes. To this mixture are added 330 parts of a 66% aqueous aluminum phosphate solution prepared according to the procedure of Example 1, having a viscosity of 250–300 centipoises, a mole ratio of phosphorus to total moles of aluminum and boron of 3:1 and about 20 mole % of boron based upon the moles of aluminum. The mixture is then agitated for 2 minutes.

The resulting foundry mix is formed into a disc shaped sand core 7 inches in diameter, 2½ inch thick and having core prints ½ inch thick and 1¼ inch diameter at the axis of the disc and on both sides thereof. The sand core is placed in a sand mold with a disc shaped cavity about 8 inches in diameter, about 3½ inch thick having a 1¼ inch hole at the axis, and a hole offset from the axis for pouring the metal. The sand core is held in place in the mold by the core prints. Molten aluminum at about 1500° F is poured into the mold. The metal is then allowed to cool to ambient temperature by standing for about 24 hours. The mold is then subjected to mechanical shakeout treatment by banging with a hammer about 4 times whereby about one-half of the sand core shakes out. The mold is then placed in water at room temperature for about one-half hour. After this the remainder of the sand core shakes out from the mold. The mold is open and a hollow aluminum casting is obtained.

We claim:

1. A process for the fabrication of foundry shapes which comprises:

a. mixing foundry aggregate having an average particle size of no less than about 150 mesh (Tyler Screen Mesh) with a bonding amount of up to about 10 percent by weight based upon the weight of the aggregate of the composition which comprises:

i. boronated aluminum phosphate containing boron in an amount from about 3 mole percent to about 40 mole percent based upon the moles of aluminum and containing a mole ratio of phosphorus to total moles of aluminum and boron of about 2:1 to about 4:1;

ii. an oxygen-containing alkaline earth metal compound capable of reacting with the aluminum phosphate and which contains alkaline earth metal and an oxide; and iii. water;

wherein the amount of boronated aluminum phosphate is from about 50 to about 95% by weight based upon the total weight of aluminum phosphate and alkaline earth compound; the amount of alkaline earth compound is from about 50 to about 5% by weight based upon the total weight of aluminum phosphate and alkaline earth compound; and the amount of water is from about 15 to about 50% by weight based upon the total weight of boronated aluminum phosphate and water; and wherein the quantity and particle size of said aggregate are such to provide sufficient porosity in the foundry shape to permit escape of volatiles from the shape during casting;

B. introducing the foundry mix obtained from step (A) into a pattern;

C. allowing the foundry mix to remain in the pattern for a time at least sufficient for the mix to become self-supporting; and D. thereafter removing the shaped foundry mix of step (C) from the pattern, and allowing it to cure at room temperature, thereby obtaining a hard, solid, cured foundry shape.

2. The method of claim 1 wherein about 80 percent of the foundry aggregate has an average particle size of between about 50 and about 120 mesh (Tyler screen mesh).

3. The method of claim 1 wherein the foundry aggregate is initially mixed with the alkaline earth metal material and is subsequently mixed with water and the boronated aluminum phosphate.

4. The method of claim 1 wherein the binder composition is a two-package system comprising the aluminum phosphate and water components in one package and the alkaline earth metal component in the other package, the alkaline earth metal component is first mixed with the foundry aggregate and the aluminum phosphate and water component is then mixed with the foundry aggregate.

* * * * *

UNITED STATES PATENT AND TRADEMARK OFFICE

CERTIFICATE OF CORRECTION

PATENT NO. : 4,070,195

DATED : January 24, 1978

INVENTOR(S) : Richard H. Toeniskoetter, John J. Spiwak

It is certified that error appears in the above-identified patent and that said Letters Patent are hereby corrected as shown below:

In column 14, line 34, should read "about 2-1/2 months, precipitated before 6 months".

Signed and Sealed this

*Twenty-fourth* Day of *June 1980*

[SEAL]

*Attest:*

SIDNEY A. DIAMOND

*Attesting Officer*

*Commissioner of Patents and Trademarks*